US007775192B2

(12) United States Patent
Wuetherich et al.

(10) Patent No.: US 7,775,192 B2
(45) Date of Patent: Aug. 17, 2010

(54) RADIAL PISTON PUMP FOR FUEL INJECTION SYSTEM HAVING IMPROVED HIGH-PRESSURE RESISTANCE

(75) Inventors: Paul Wuetherich, Schwieberdingen (DE); Josef Guentert, Gerlingen (DE); Karl-Heinz Linek, Remseck (DE); Florian Kleer, Merchweiler (DE); Gerd Loesch, Filderstadt-Sielmingen (DE); Peter Grabert, Hoechen (DE); Nicola Cimaglia, Putignano (IT); Antonio Diaferia, Corato Bari (IT); Rosanna Iorizzo, Molfetta (IT); Sandra Ranaldo, Bologna (IT); Giuseppe Palma, Bergamo (IT)

(73) Assignee: Robert Bosch GmbH, Stuttgart (DE)

( * ) Notice: Subject to any disclaimer, the term of this patent is extended or adjusted under 35 U.S.C. 154(b) by 863 days.

(21) Appl. No.: 10/513,993

(22) PCT Filed: May 13, 2003

(86) PCT No.: PCT/DE03/01541

§ 371 (c)(1),
(2), (4) Date: May 25, 2005

(87) PCT Pub. No.: WO03/095839

PCT Pub. Date: Nov. 20, 2003

(65) Prior Publication Data

US 2005/0207908 A1 Sep. 22, 2005

(30) Foreign Application Priority Data

May 14, 2002 (DE) ..... 102 21 305

(51) Int. Cl.
*F02M 37/04* (2006.01)

(52) U.S. Cl. ..... 123/495; 123/456; 123/468; 123/469; 417/273; 417/269; 137/539

(58) Field of Classification Search ..... 123/495, 123/468, 469, 456; 417/273, 269; 137/539
See application file for complete search history.

(56) References Cited

U.S. PATENT DOCUMENTS

| | | | | |
|---|---|---|---|---|
| 3,077,896 | A * | 2/1963 | Weingard | 137/329.06 |
| 3,359,995 | A * | 12/1967 | Parisi et al. | 137/102 |
| 3,742,926 | A * | 7/1973 | Kemp | 123/467 |
| 6,345,609 | B1 * | 2/2002 | Djordjevic | 123/509 |
| 6,514,050 | B1 * | 2/2003 | Streicher | 417/273 |
| 6,588,405 | B1 * | 7/2003 | Streicher et al. | 123/495 |
| 2002/0134354 | A1 * | 9/2002 | Klingel | 123/456 |

FOREIGN PATENT DOCUMENTS

| | | | |
|---|---|---|---|
| DE | 198 02 476 | A1 | 7/1999 |
| DE | 100 29 425 | A1 | 12/2001 |
| DE | 100 29 431 | A1 | 12/2001 |
| EP | 1045142 | * | 3/2000 |
| EP | 1 188 926 | A2 | 3/2002 |

OTHER PUBLICATIONS

Arnold et al., Machine Translation of EP 1045142.*

* cited by examiner

*Primary Examiner*—Devon C Kramer
*Assistant Examiner*—Christopher Bobish
(74) *Attorney, Agent, or Firm*—Ronald E. Greigg

(57) ABSTRACT

A radial piston pump has a pump housing containing pump elements and whose high-pressure conduits extending in the pump housing are embodied so as to significantly increase the permissible operating pressures.

18 Claims, 9 Drawing Sheets

RADIAL PISTON PUMP FOR FUEL INJECTION SYSTEM HAVING IMPROVED HIGH-PRESSURE RESISTANCE

CROSS-REFERENCE TO RELATED APPLICATIONS

This application is a 35 USC 371 application of PCT/DE 03/01541 filed on May 13, 2003.

BACKGROUND OF THE INVENTION

1. Field Of The Invention
2. Description of the Prior Art

The invention relates to a radial piston pump for high-pressure fuel delivery in fuel injection systems of internal combustion engines, particularly in a common rail injection system, preferably with a number of pump elements arranged radially in relation to a drive shaft supported in a pump housing, the pump elements being actuated by the drive shaft and each having a respective inlet side and high-pressure side, and with high-pressure conduits in the pump housing, each of which connects the high-pressure side of a respective pump element to a high-pressure connection in the pump housing.

A radial piston pump of the type with which this invention is concerned is known, for example, from DE 197 29 788.9 A1. This mass-produced radial piston pump achieves operating pressures of up to 1300 bar on the high-pressure side. These pressures result in considerable mechanical stresses in the pump housing.

In order to further improve the emissions behavior of internal combustion engines and to further increase efficiency, it is necessary to provide higher injection pressures than the above-mentioned 1300 bar.

The object of the invention is therefore to modify a radial piston pump so that it can be used for pressures of up to 2000 bar.

In a radial piston pump for high-pressure fuel delivery in fuel injection systems of internal combustion engines, preferably with a number of pump elements arranged radially in relation to a drive shaft supported in a pump housing, the pump elements being actuated by the drive shaft and each having a respective inlet side and high-pressure side, and with high-pressure conduits in the pump housing, each of which connects the high-pressure side of a respective pump element to a high-pressure connection in the pump housing, this object is attained according to the invention in that the high-pressure conduits have as few junctions as possible and in that the angle at which one high-pressure conduit branches off from another high-pressure conduit is as close as possible to 90°.

SUMMARY AND ADVANTAGES OF THE INVENTION

The routing of the high-pressure conduits in the pump housing in the manner according to the invention makes it possible, in spite of increased pump pressures, to achieve a reduction in the maximal stresses occurring at critical points in the pump housing. As a result, the radial piston pump according to the invention can be operated at higher pressures while at the same time experiencing a reduced strain on the material.

The maximal stresses occurring are determined by means of FEM calculations. In trials with prototypes, the improved compression strength of the pump housing turned out to be due to the routing of the high-pressure conduits in the manner according to the invention.

According to a modification of the invention, the surfaces of the high-pressure conduits are compacted and provided with compressive internal stresses in particular by means of a sphere, whose diameter is slightly greater than the diameter of the high-pressure conduits, being drawn or pressed through the high-pressure conduits. This step further increases the compression strength of the pump housing in the region of the high-pressure conduits.

According to the invention, it is also possible for the high-pressure conduits to be hardened, in particular induction hardened. In order to further minimize the maximal stresses of the pump housing that occur with the exertion of pressure, the high-pressure conduits are rounded, in particular by means of hydrodynamic erosion, in the region of cross sectional changes and/or junctions with other high-pressure conduits.

According to a particularly advantageous embodiment of the radial piston pump according to the invention, the high-pressure conduits are reinforced by a tubular insert, in particular an insert made of a high-strength material; high-tensile steel has turned out to be a particularly suitable material. The tubular inserts according to the invention are, like a core, inserted into the mold before casting. The casting bonds the pump housing and tubular inserts to each other in a very intimate fashion. Because of the tubular inserts, the high-pressure conduits are comprised of a different material, particularly preferably a stronger one, than the rest of the pump housing, and as a result, the component strength is adapted to the local strains and stresses. This assures that, on the one hand, in the region of the high-pressure conduits where the highest stresses occur during operation, a higher-strength material is used, which can reliably withstand the stresses that occur, and on the other hand, the rest of the pump housing can be made of a comparatively inexpensive material that can also be easily machined and has good antifrictional properties.

Another advantage of the tubular inserts according to the invention is that by contrast with conventional bores, the high-pressure conduits can be embodied as curved or partially curved. It is also possible to use a separate insert to connect the high-pressure side of each pump element directly to the high-pressure connection in the pump housing, thus eliminating the need for any junctions in the high-pressure conduits. This has a favorable effect on the maximal stresses occurring in the pump housing, on the manufacturing costs, and in particular on the production safety.

According to another variant of a radial piston pump according to the invention, each pump element has a cylinder bore and a cylinder head, the piston oscillates in the piston bore and feeds a delivery chamber, a first check valve is disposed on the inlet side, and a second check valve is disposed on the high-pressure side. It has turned out to be advantageous if the cylinder bore is embodied as a blind bore and the first check valve is disposed at the bottom of the blind bore. Embodying the cylinder bore as a blind bore eliminates one seal location.

According to another modification of the invention, the second check valve has a sleeve with a stepped center bore, the stepped center bore has a sealing seat for a valve element, in particular a ball, particularly preferably a ceramic ball, and the sleeve of a screw sealing plug is pressed against the cylinder head in a sealed fashion. This second check valve has the advantage that it is very simply designed and can be tested outside the radial piston pump. All that needs to be provided inside the radial piston pump or pump element is a sealing surface that seals the screwed-in second check valve at its end. In production engineering terms, a sealing surface of this kind is easy to control, thus making it easier to seal the high-pressure side of the pump element in relation to the environment at this location through the use of the second check valve according to the invention.

Sealing the high-pressure side in relation to the environment is particularly effective if the sleeve has a biting edge on its end surface oriented toward the screw sealing plug, thus increasing the surface pressure and also permitting a plastic deformation of the sealing surfaces, which further improves the sealing function.

If the sleeve is pressed-fitted onto the screw sealing plug, particularly in the region of the center bore, then this further simplifies the installation of the check valve since it assures that the assembled, tested check valve will not come apart.

In order to assure a constant hydraulic connection between the delivery chamber on the one hand and the high-pressure connection in the pump housing on the other when the second check valve is open, the sleeve has a lateral bore and an annular groove, and the lateral bore and annular groove produce a hydraulic connection between the center bore and the delivery chamber.

In another variant of a first or second check valve, a sealing seat is incorporated into the side of the cylinder head oriented toward the pump housing; the check valve has a cage, which contains a closing spring that acts on the valve member, in particular a ball. The closing spring reduces the return flow of fuel, which has an advantageous effect on the pump efficiency.

The installation of the check valve according to the invention into the pump element is simplified if the cage is press-fitted into a stepped bore encompassing the sealing seat.

In an embodiment that is advantageous from a production engineering standpoint, the cylinder bore is embodied as a blind bore and the first check valve is disposed at the bottom of the blind bore so that the sealing seat of the first and second check valves can be produced in one setup and the first and second check valves are installed in the same direction.

BRIEF DESCRIPTION OF THE DRAWINGS

Other advantages and advantageous features of the invention with be apparent from the description contained herein below, taken in conjunction with the drawings, in which.

DESCRIPTION OF THE PREFERRED EMBODIMENTS

Figure 1A:
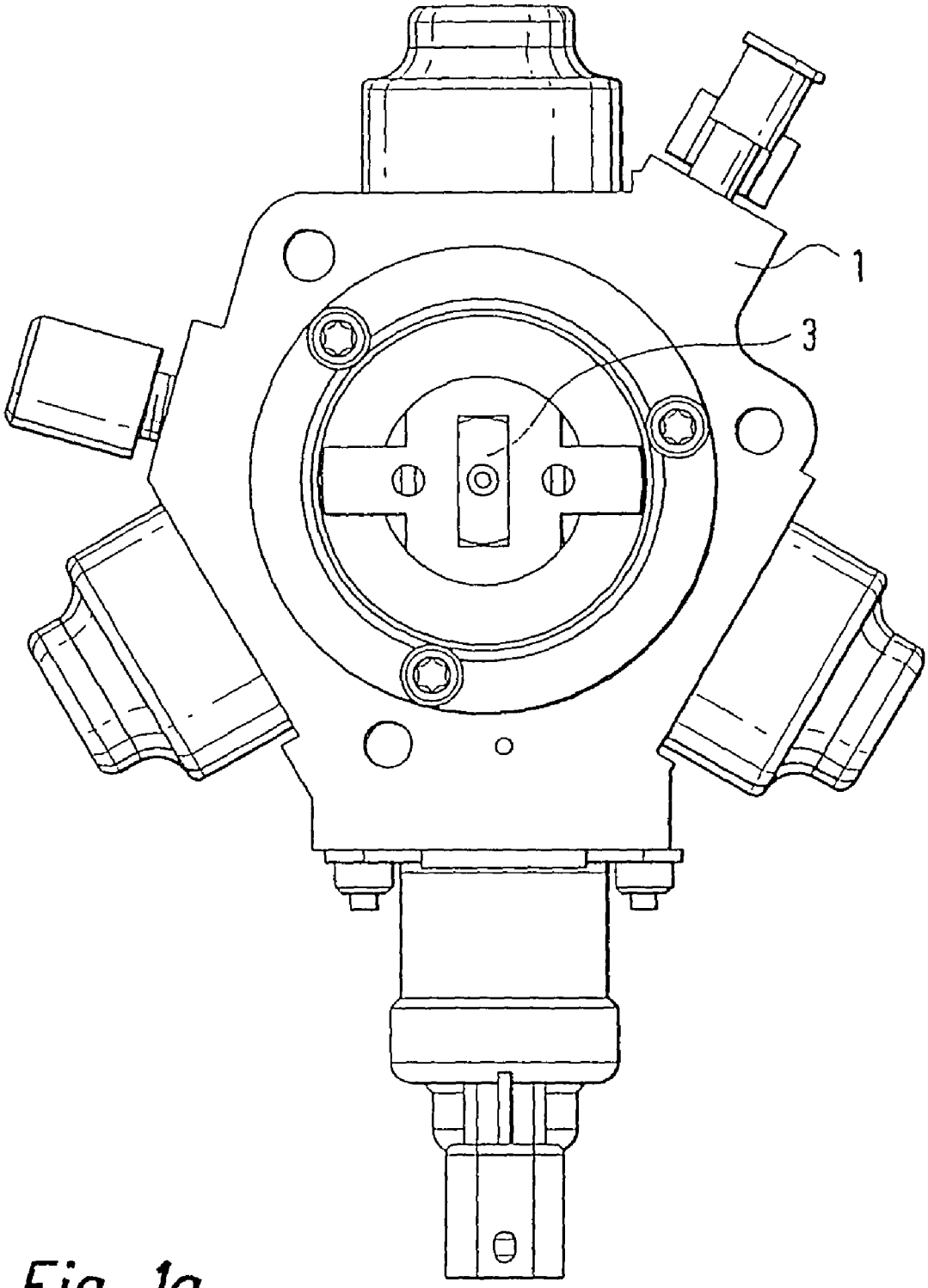
FIG. 1*a* is a front view of a first exemplary embodiment of a radial piston pump according to the invention.
Figure 1B:
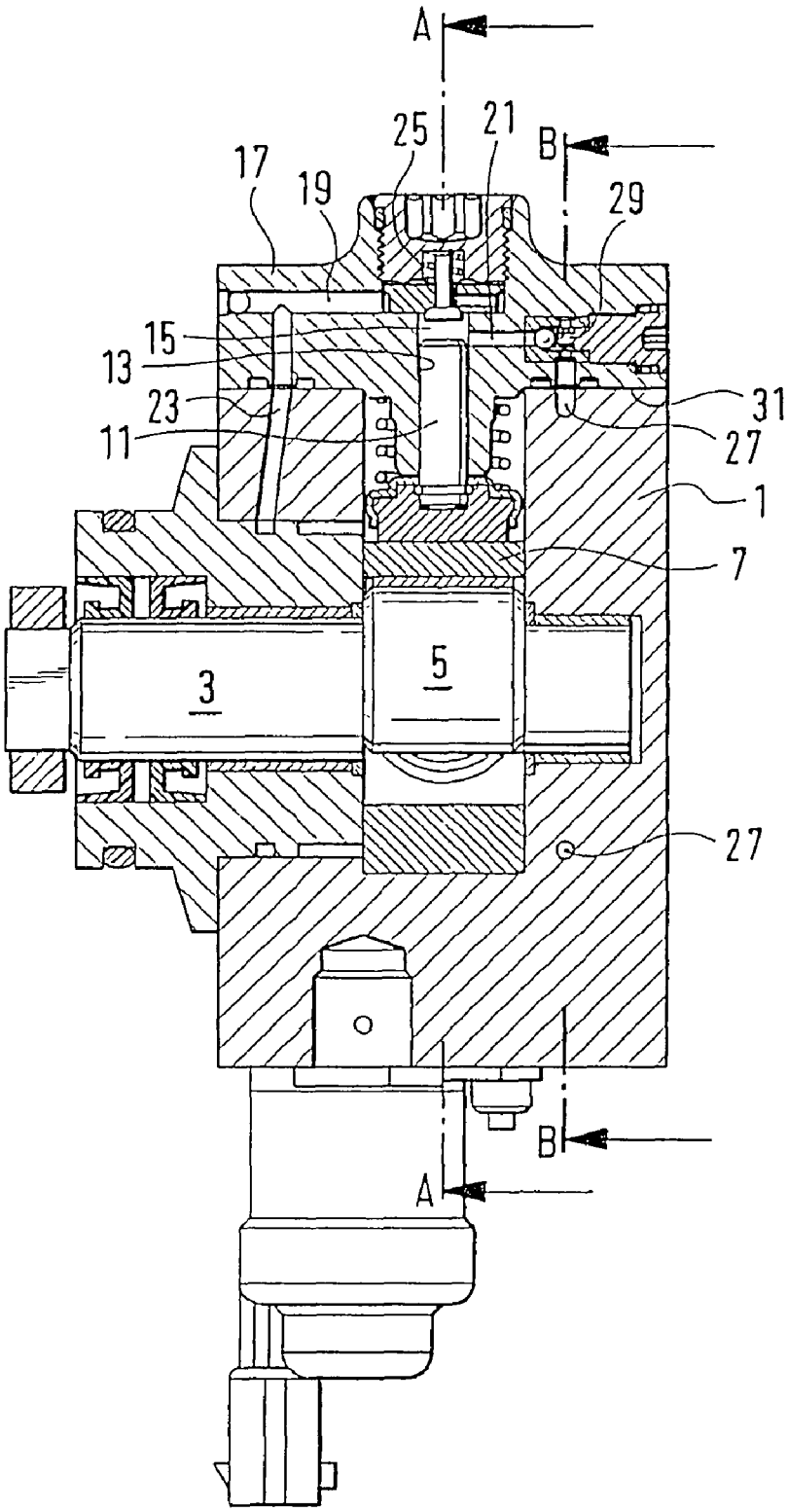
FIG. 1*b* is a longitudinal section through the exemplary embodiment according to FIG. 1*a*.
Figure 1C:
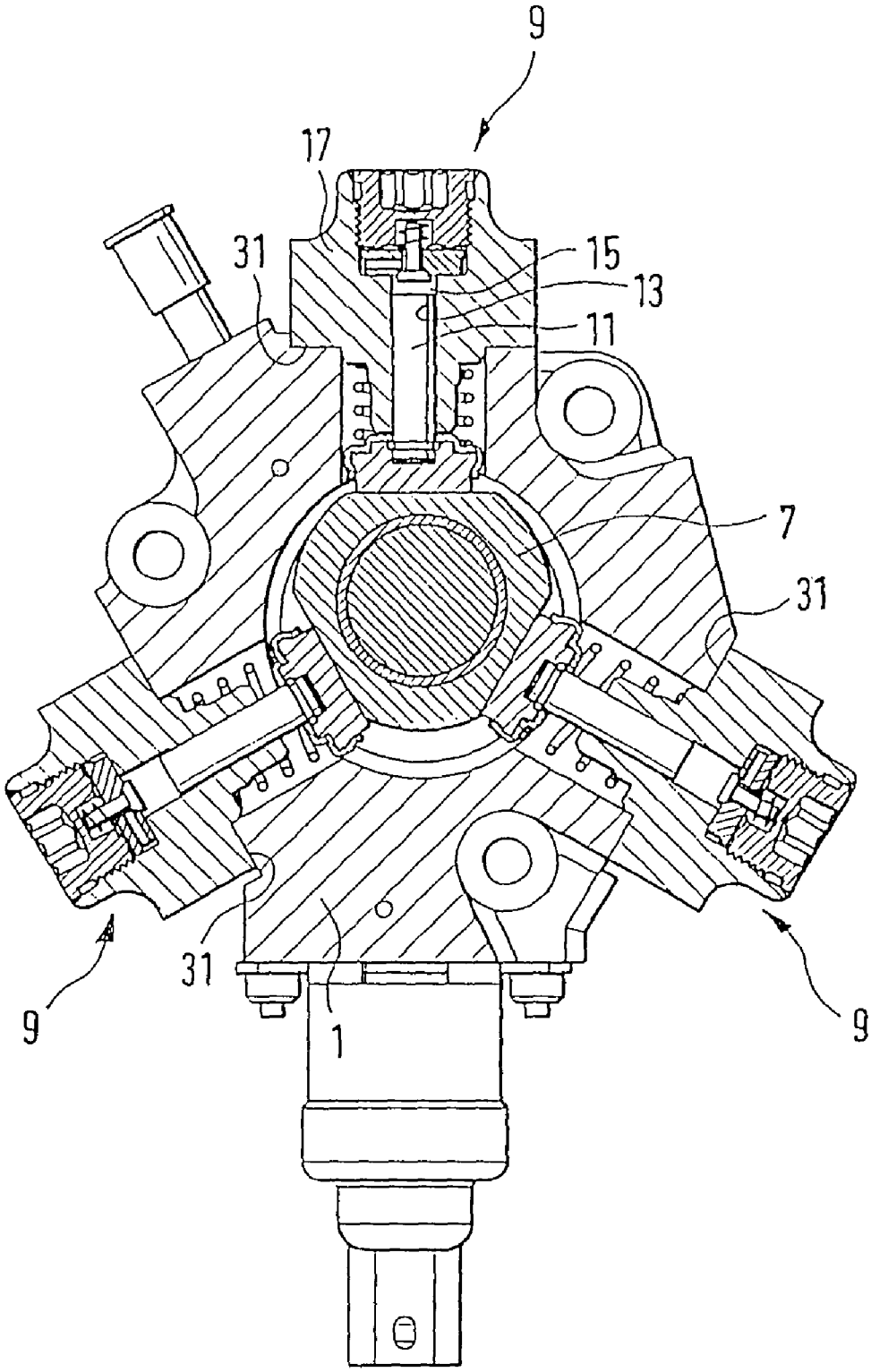
FIG. 1*c* is a cross section through the exemplary embodiment, along the line A-A of FIG. 1*b*.

FIG. 1 shows an exemplary embodiment of a radial piston pump according to the invention in a view from the front (FIG. 1*a*), in a longitudinal section (FIG. 1*b*), and in a cross section along the section line A-A. The radial piston pump is comprised of a pump housing 1 in which a drive shaft 3 is mounted in rotary fashion. The pump housing 1 can be advantageously made of cast iron with globular graphite (GGG). The drive shaft 3 has an eccentric section 5. By means of a polygon ring 7, the eccentric section 5 drives three pump elements 9 distributed over the circumference. Each pump element 9 has a piston 11 that is guided in a cylinder bore 13 and delimits a delivery chamber 15. Not all of the individual components of all of the pump elements 9 in FIG. 1*c* are provided with reference numerals in order to avoid unnecessarily compromising clarity. The three pump elements 9, however, are all embodied identically.

A cylinder head 17 of the pump elements 9 contains an inlet side 19 and a high-pressure side 21. The inlet side 19 of the cylinder head 17 is supplied with fuel via a low-pressure bore 23 in the pump housing. On the inlet side 19, a first check valve 25 is provided, which prevents the return flow of fuel (not shown) from the delivery chamber 15 into the low-pressure bore 23.

The high-pressure side 21 of the pump element 9 feeds into a high-pressure conduit 27 in the pump housing 1. On the high-pressure side 21 of the pump element, a second check valve 29 is provided, which prevents the return flow of highly pressurized fuel from the high-pressure conduit 27 into the delivery chamber 15. The pump elements 9 are screw-mounted to the pump housing 1 by means of screws, not shown, and are pressed against a cylinder base surface 31 of the pump housing 1 by this screw connection.

Each pump element 9 has a high-pressure conduit 27 leading from it in the pump housing 1, which feeds into a high-pressure connection not shown in FIGS. 1*a* to 1*c*. The course of the high-pressure conduits will be explained below in conjunction with FIGS. 2 and 3. The lower half of a second high-pressure conduit 27 is depicted in FIG. 1*b*. Since this high-pressure conduit extends essentially perpendicular to the plane of the drawing, it is depicted as a circular area in FIG. 1*b*.

The above-described design and the function of such a radial piston pump are known from the prior art, for example from DE 197 29 788.9 A1, the disclosure of which is expressly incorporated herein by reference, thus rendering a detailed explanation of the function unnecessary in connection with the current invention.

FIG. 2 shows a cross section through a pump housing 1 along the section line B-B. This depiction clearly shows the course of the high-pressure conduits 27 according to a first exemplary embodiment of the invention.

FIG. 2 shows only the pump housing 1. The pump elements 9 are not shown in FIG. 2. Since the high-pressure conduits 27 in the pump housing 1 are subjected to the full delivery pressure of the pump elements, considerable stresses are produced in the pump housing 1 during the operation of the radial piston pump, which are substantially due to the pressures prevailing in the high-pressure conduits 27*a* to 27*c*. Up to this point, mass-produced radial piston pumps with inserted pump elements 9 have been used at operating pressures of up to 1300 bar. If it is now necessary to further increase the operating pressures, then it is necessary to maintain or even improve the fatigue strength of the pump housing, primarily in the region of the high-pressure conduits 27*a*. Arranging the high-pressure conduits 27*a*, 27*b*, and 27*c* in the manner according to the invention makes it possible, in the presence of the same pressures, to drastically reduce the stresses occurring in the pump housing so that the permissible operating pressures can be increased to over 1800 bar with the same component strength. Even at these operating pressures, which have been increased in comparison to the above-mentioned operating pressures according to the prior art (maximally 1300 bar), the mechanical strain on the pump housing is lower than in the radial piston pumps according to the prior art.

Figure 2A:
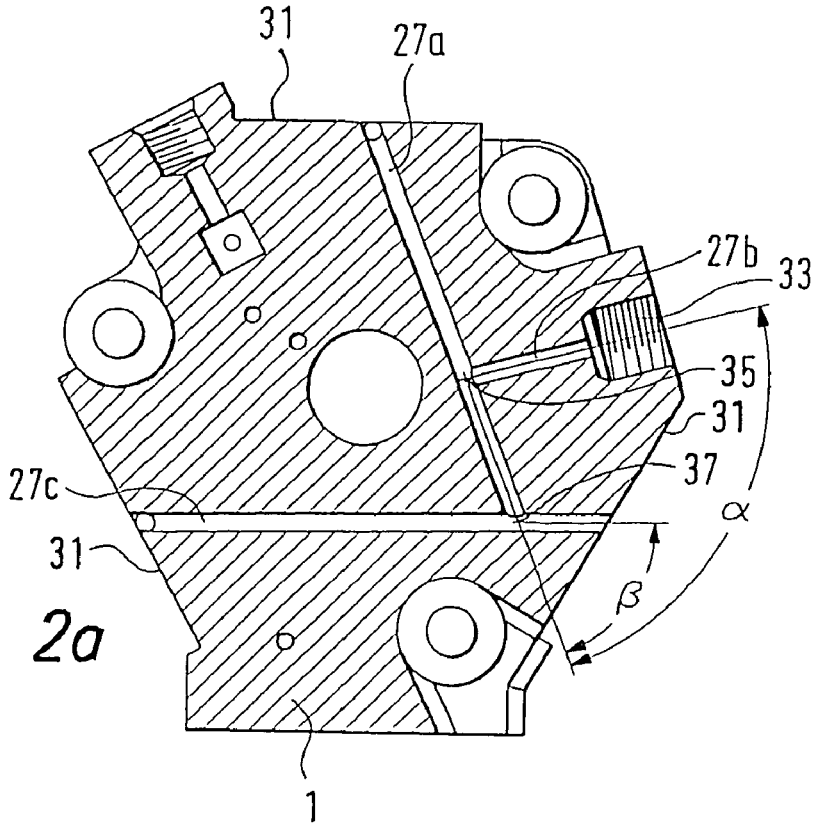
FIG. 2*a* is a cross section through the first exemplary embodiment, along the line B-B of FIG. 1*b*.
Figure 2B:
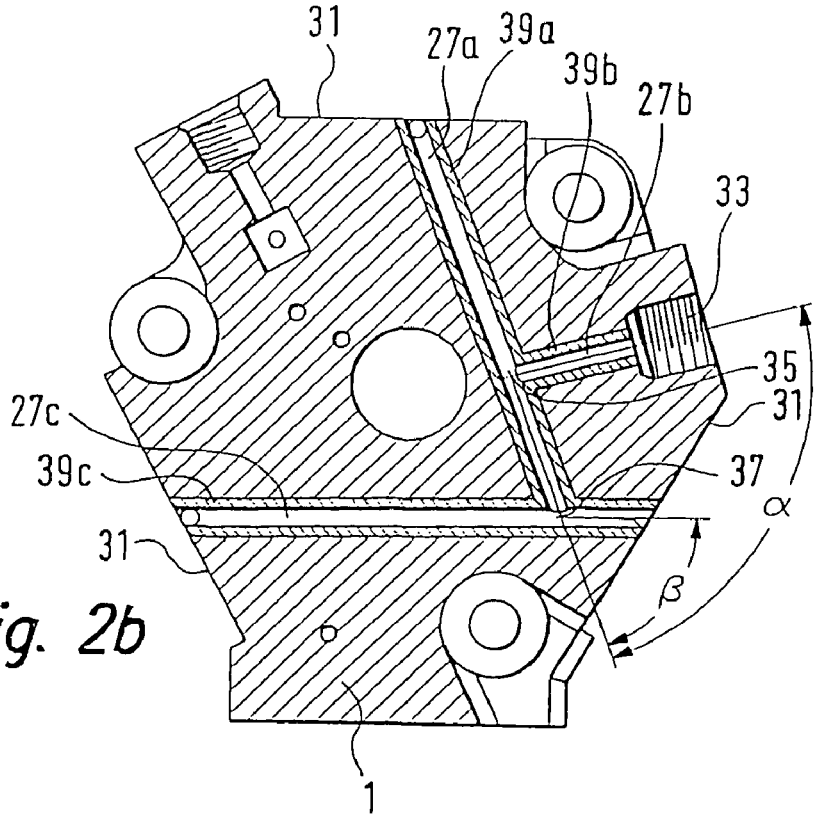
FIG. 2*b* is an embodiment alternative to the one in FIG. 2*a*.

This is achieved according to the invention by minimizing the number of high-pressure conduits. In the current instance, three high-pressure conduits 27*a*, 27*b*, 27*c*suffice to produce a hydraulic connection from the three cylinder base surfaces 31 to a high-pressure connection 33. The high-pressure conduit 27*b* here branches off from the high-pressure conduit 27*a* at an angle α of approximately 90° . The angle α should be as close as possible to 90° in order to minimize the stresses occurring at the first junction 35 during operation. The high-pressure conduit 27*a*intersects the high-pressure conduit 27*c*at an angle β and forms a second junction 37. As shown in FIGS. 2*a* and 2*b* , the high pressure conduits (27) extend to the three surfaces (31) where they connect to the three pump elements and they have fewer junctions (35,37) than the number of pump elements. The angle β should also be as close as possible to 90° , however, it is not always possible to make angles α and β a full 90° , given the structural conditions in the pump housing 1, so instead they are characterized as substantially 90° . FEM calculations have demonstrated that arranging the high pressure conduits 27*a* , 27*b*, and 27*c* in the manner according to the invention has resulted in a reduced maximal stress in the pump housing 1 compared to mass produced radial piston pumps, even at Significantly higher operating pressures. This has made it possible to increase the permissible operating pressures from 1300 bar to over 1800 bar, without being forced to select a material that is more expensive than the cast iron with globular graphite (GGG) known from prior art.

A further increase in engineering strength can be achieved by reinforcing the high-pressure conduits 27*a* with tubular inserts, in particular ones made of a high-strength material. FIG. 2*b* shows an exemplary embodiment of a pump housing 1 in which the high-pressure conduits 27*a* to 27*c* have been reinforced with tubular inserts. The tubular inserts 39 are attached to one another in the region of the first junction 35 and the second junction 37. They are advantageously attached to one another by means of welding or soldering. These tubular inserts 39*a* 31*a* to 39*c* can further increase the strength of the pump housing 1. The tubular inserts 39*a* to 39*c* are inserted into the mold before the casting of the pump housing 1. During the subsequent casting of the pump housing 1, the tubular inserts 39 are intimately bonded to the pump housing 1, thus resulting in an optimal transmission of force between the tubular insert 39 and the pump housing 1.

Figure 3:
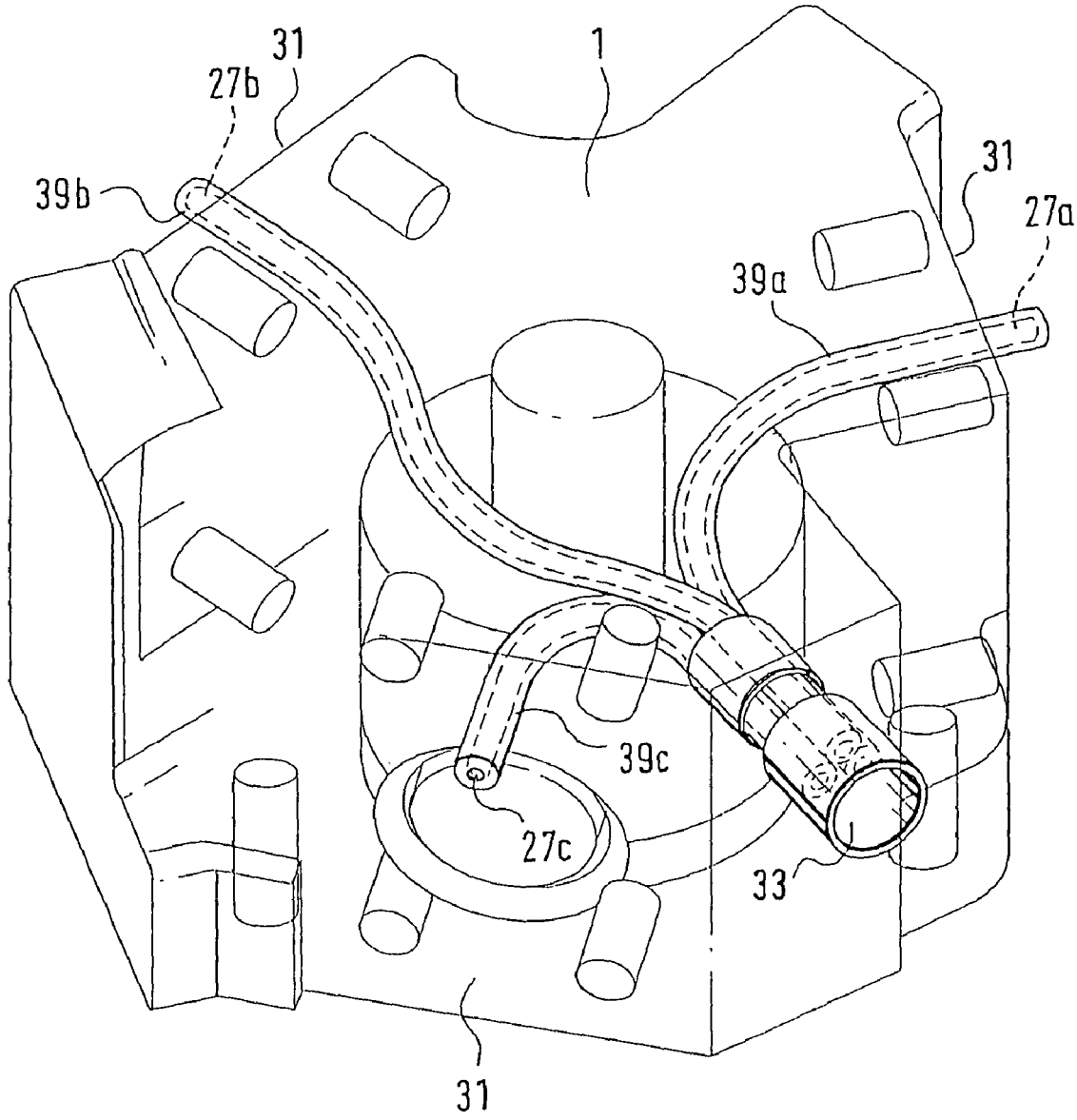
FIG. 3 is a three-dimensional depiction of another exemplary embodiment of a pump housing according to the invention.

FIG. 3 is a three-dimensional depiction of another exemplary embodiment of a pump housing according to the invention. It is clear that in this exemplary embodiment, the high-pressure conduits 27*a*, 27*b*, and 27*c* are embodied as curved and each lead directly, i.e. without junctions, from a cylinder base surface 31 to the high-pressure connection 33. In this embodiment, the strains in the pump housing 1 resulting from operating pressures are further reduced due to the lack of junctions. From a production engineering standpoint, this embodiment can be produced by means of curved tubular inserts 39*a*, 39*b*, and 39*c*.

Figure 4:
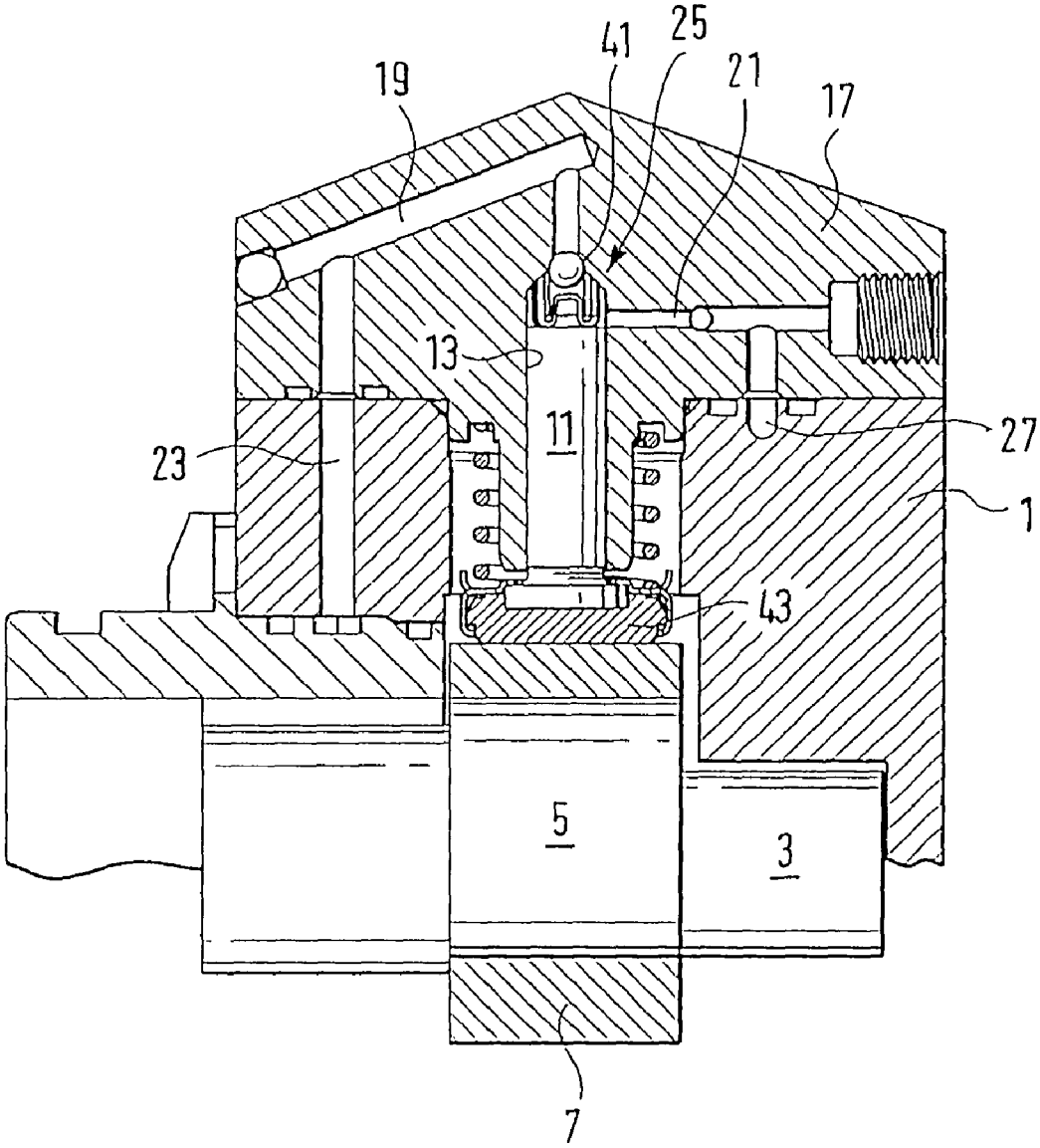
FIG. 4 shows another exemplary embodiment of a cylinder head according to the invention.

FIG. 4 shows an exemplary embodiment of a radial piston pump according to the invention in which the cylinder bore 13 in the pump element 9 is embodied as a blind bore. At the bottom of the blind bore, a sealing seat 41 is provided for the first check valve 25. The first check valve 25 can be embodied as structurally identical to the second check valve 29 described in conjunction with FIGS. 6 and 7. In the exemplary embodiment according to FIG. 4, the piston 11 is likewise driven by means of a polygon ring and a piston base plate 43. The invention, however, is not limited to radial piston pumps with pump elements 9 driven in this manner. On the contrary, it can also include alternative drive methods such as disk cams or the like. The piston bases can also include tappets (not shown) that are guided in the pump housing 1.

Figure 5A:
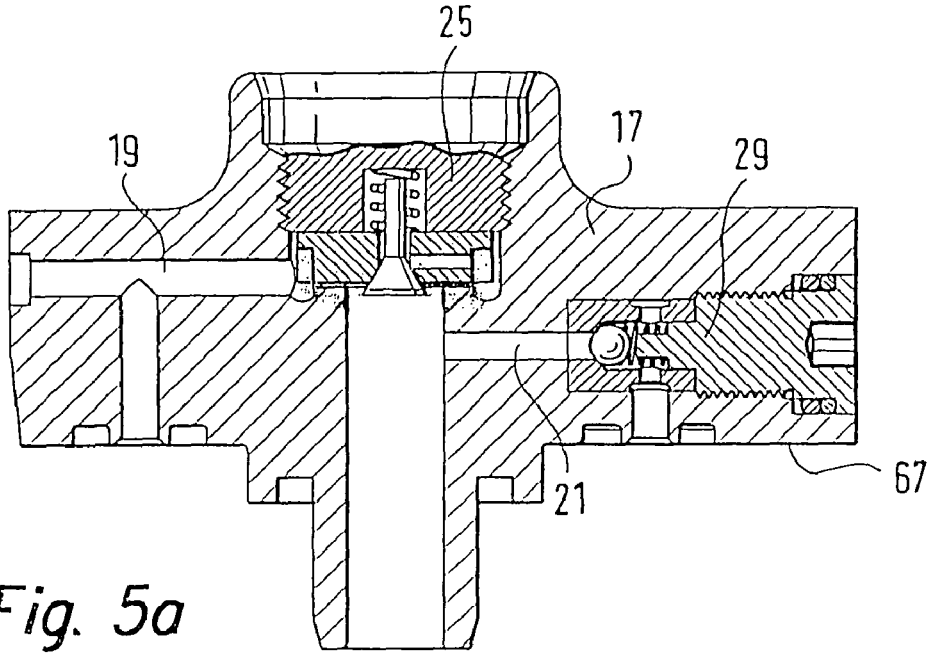
FIGS. 5 and 6 are longitudinal sections through other exemplary embodiments of cylinder heads according to the invention, and FIGS. 7*a* and *b* show details of the check valve according to the exemplary embodiment in FIG. 6.
Figure 5B:
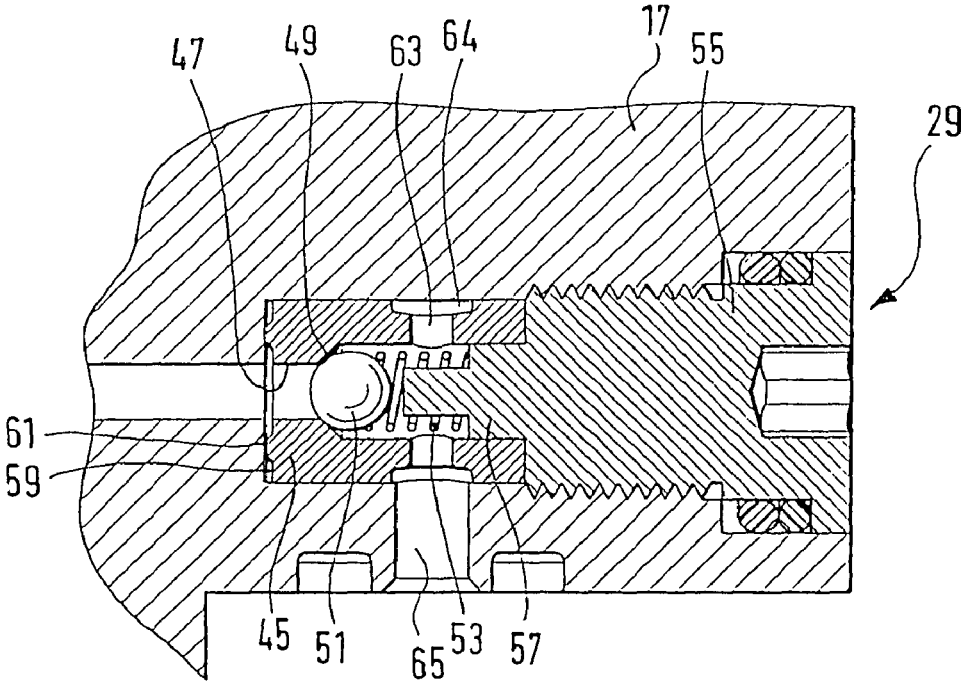

FIG. 5*a* shows a cross section through a cylinder head 17 of another exemplary embodiment of a radial piston pump according to the invention. The first check valve 25 corresponds to the check valve 25 shown in FIG. 1. The second check valve 29 indicated in FIG. 1*b* will be illustrated and explained below in conjunction with FIG. 5*a* and FIG. 5*b*, which shows an enlarged detail from FIG. 5*a*.

The second check valve 29 is comprised of a sleeve 45. A sealing seat 49 for a ball 51, in particular a ceramic ball, is let into the stepped bore 47 of sleeve 45. A closing spring 53, which is supported against a screw sealing plug 55, presses the ball 51 against the sealing seat 49. The use of a closing spring 53 can increase the efficiency of the radial piston pump according to the invention by several percentage points since this prevents a return flow of fuel from the high-pressure conduit 27 not shown in FIG. 5*b* into the delivery chamber 15, also now shown. The sleeve 45 is press-fitted onto a shoulder 57 of the screw sealing plug 55 so that the second check valve 29 according to the invention can be preassembled with the screw sealing plug 55 and tested ahead of time. On its end surface 59 oriented away from the screw sealing plug 55, the sleeve 45 has a circumferential biting edge 61, which is used to seal the second check valve 29 against the cylinder head 17. A lateral bore 63 and an annular groove 64 in the sleeve 45 permit fuel to flow out into a bore 65 in the cylinder head 17 when the second check valve is open.

Figure 6:
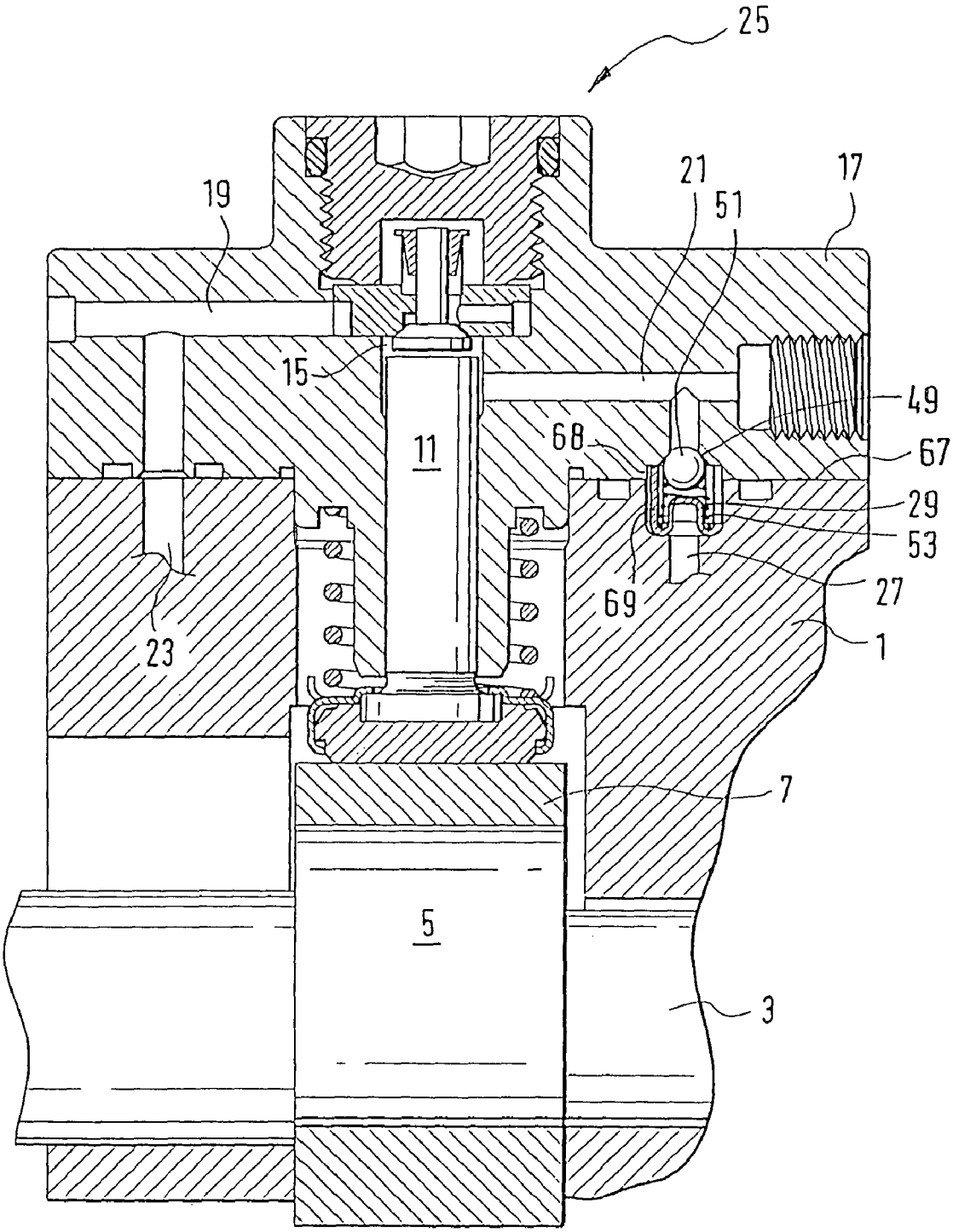

FIG. 6 shows another exemplary embodiment of a radial piston pump according to the invention. In this exemplary embodiment, the second check valve 29 is disposed on the side 67 of the cylinder head 17 oriented into the housing 1.

The sealing seat 49 is incorporated into the cylinder head 17. The sealing seat 49 is adjoined by a cylindrical bore 68. The bore 68 has a cage 69 press-fitted into it, which contains a closing spring 53 that presses the ball 51 against the sealing seat 49. This second check valve 29 according to the invention is very easy to manufacture and assemble. It can also be used as a first check valve 25, for example in an embodiment according to FIG. 4. In this instance, it is very advantageous in terms of production that the sealing seat 41 of the first check valve 25 and the sealing seat 49 of the second check valve are disposed parallel to each other, which makes it easier to machine them in one setup of the cylinder head.

Figure 7A:
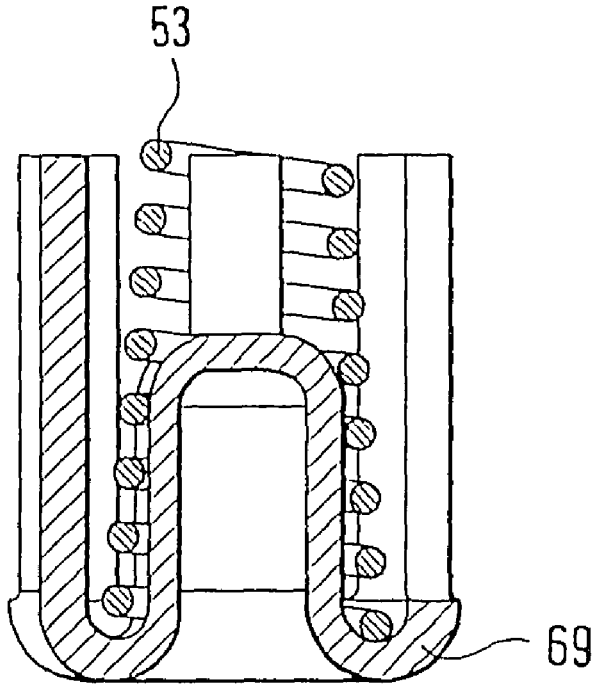
Figure 7B:
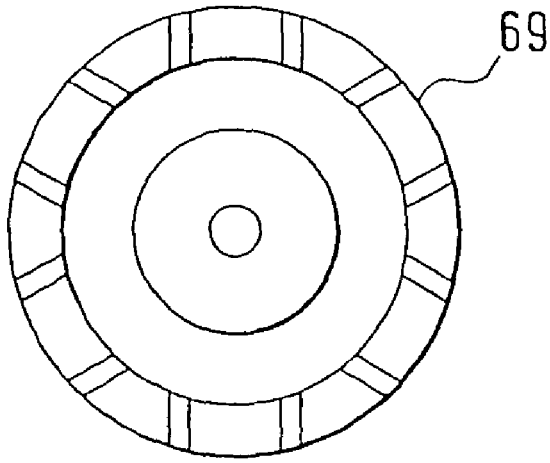

FIG. 7*a* shows a longitudinal section through the cage 69 with the closing spring 53 inserted and FIG. 7*b* shows a top view of the cage 69 without the closing spring 53.

All features mentioned or depicted in the drawings, their description, and the claims can be essential to the invention both individually and in arbitrary combinations with one another.

The foregoing relates to preferred exemplary embodiments of the invention, it being understood that other variants and embodiments thereof are possible within the spirit and scope of the invention, the latter being defined by the appended claims.

The invention claimed is:

1. In a radial piston pump for high-pressure fuel delivery in fuel injection systems of internal combustion engine, including a number of pump elements (9) arranged radially in relation to a drive shaft (3) supported in a pump housing (1), the pump elements (9) being actuated by the drive shaft (3) and each having a respective inlet side (19) and high-pressure side (21), and with high-pressure conduits (27) in the pump housing (1), each of which connects the high-pressure side (21) of at least one pump element (9) to a high-pressure connection (33) in the pump housing (1), the improvement comprising a first one of the high-pressure conduits (27) which connects directly to two pump elements, and a second of the high-pressure conduits which connects directly to connecting another pump element and also connects directly to said first high-pressure conduit at a junction which has an angle (α, β) which is substantially 90°, and wherein the high-pressure connection (33) connects directly to only one of said first or second high-pressure conduits, and does so at an angle (α, β) which is also substantially 90°.

2. In a radial piston pump for high-pressure fuel delivery in fuel injection systems of internal combustion engine, including a number of pump elements (9) arranged radially in relation to a drive shaft (3) supported in a pump housing (1), the pump elements (9) being actuated by the drive shaft (3) and each having a respective inlet side (19) and high-pressure side (21), and with high-pressure conduits (27) in the pump housing (1), each of which connects directly to the high-pressure side (21) of a respective pump element and one of which directly connects (9) to a high-pressure connection (33) in the pump housing (1), the improvement comprising the high-pressure conduits (27) having fewer junctions (35, 37) then the number of pump elements and the angle (α, β) at which one high-pressure conduit (27*a*, 27*b*, 27*c*) branches off from another high-pressure conduit (27*a*, 27*b*, 27*c*) is substantially 90°, wherein the entire inner surfaces of the high pressure conduits (27*a*, 27*b*, 27*c*) are compacted.

3. The radial piston pump according to claim 1, wherein a sphere whose diameter is slightly larger than the diameter of the high pressure conduits (27*a*, 27*b*, 27*c*) is drawn or pressed through the entire length of the high pressure conduits (27*a*, 27*b*, 27*c*) to compact the surfaces.

4. The radial piston pump according to claim 1, wherein the high pressure conduits (27*a*, 27*b*, 27*c*) are hardened by induction hardening.

5. The radial piston pump according to claim 1, wherein the high pressure conduits are rounded by means of hydrodynamic erosion, in the region of cross sectional changes and/or junctions (35, 37) with other high pressure conduits.

6. In a radial piston pump for high-pressure fuel delivery in fuel injection systems of internal combustion engine, including a number of pump elements (9) arranged radially in relation to a drive shaft (3) supported in a pump housing (1), the pump elements (9) being actuated by the drive shaft (3) and each having a respective inlet side (19) and high-pressure side (21), and with high-pressure conduits (27) in the pump housing (1), each of which connects the high-pressure side (21) of a respective pump element (9) to a high-pressure connection (33) in the pump housing (1), the improvement comprising the high-pressure conduits (27) having fewer junctions (35, 37) then the number of pump elements and the angle (α, β) at which one high-pressure conduit (27*a*, 27*b*, 27*c*) branches off from another high-pressure conduit (27*a*, 27*b*, 27*c*) is substantially 90°, wherein each of the high pressure conduits (27*a, b, c*) is reinforced by a tubular insert (39*a, b, c*) each of which is encased within the housing.

7. The radial piston pump according to claim 6, wherein the inserts (39*a, b, c*) are comprised of a high-tensile steel.

8. The radial piston pump according to claim 1, wherein at least one high-pressure conduit is embodied as partially curved, and each of the conduits are encased within the housing.

9. The radial piston pump according to claim 1, wherein each pump element (9) has a piston (11), a cylinder bore (13), and a cylinder head (17), wherein the piston (11) oscillates in the cylinder bore (13) and delimits a delivery chamber (15), wherein a first check valve (25) is disposed on the inlet side (19), and wherein a second check valve (29) is disposed on the high-pressure side (21).

10. The radial piston pump according to claim 9, wherein the second check valve (29) has a sleeve (45) with a stepped center bore (47), wherein the stepped center bore (47) has a sealing seat (49) for a valve ball (51), and wherein the sleeve (45) is pressed against the cylinder head (17) in a sealed fashion by a screw sealing plug (55).

11. The radial piston pump according to claim 10, wherein the sleeve (45) has an end surface (59) which is oriented away from the screw sealing plug (55) and is embodied as a sealing surface with a biting edge (61).

12. The radial piston pump according to claim 10, wherein the sleeve (45) is press-fitted onto the screw sealing plug (55) in the region of the center bore (47).

13. The radial piston pump according to claim 10, wherein the sleeve (45) has a lateral bore (61) and an annular groove (63), and wherein the lateral bore (61) and the annular groove (63) hydraulically connect the center bore (47) to the delivery chamber (15).

14. The radial piston pump according to claim 9, wherein each cylinder head (17) has a side (67) which is oriented toward the pump housing, and a sealing seat (49) of the second check valve (29) is disposed on the side (67) of the cylinder head (17) which is oriented toward the pump housing (1).

15. The radial piston pump according to claim 1, wherein a first and/or a second check valve (25, 29) has a cage (69), and that the cage (69) contains a closing spring (53) that acts on a valve element (51).

16. The radial piston pump according to claim 15, wherein the cage (59) is press-fitted into a stepped bore (65) that is embodied in the cylinder head (17) and encompasses the sealing seat (49).

17. The radial piston pump according to claim 1, wherein a cylinder bore (13) is embodied as a blind bore and that a first check valve (25) is disposed at the bottom of the blind bore.

18. In a radial piston pump for high-pressure fuel delivery in fuel injection systems of internal combustion engines, including a number of pump elements (9) arranged radially in relation to a drive shaft (3) supported in a pump housing (1), the pump elements (9) being actuated by the drive shaft (3) and each having a respective inlet side (19) and high-pressure side (21), and with high-pressure conduits (27) in the pump housing (1), each of which connects the high-pressure side (21) of at least one pump element (9) to a high-pressure connection (33) in the pump housing (1), the improvement comprising a first one of the high-pressure conduits (27) connecting directly to two of the pump elements, and a second of the high-pressure conduits connecting directly to a third pump element (9) and also directly to the first high-pressure conduit, wherein the angle (α, β) at which said two high-pressure conduits meet is substantially at 90°.

* * * * *